US008062087B1

(12) United States Patent
Davis et al.

(10) Patent No.: US 8,062,087 B1
(45) Date of Patent: Nov. 22, 2011

(54) GLOVE WITH ATTACHED DOLL

(76) Inventors: Devyn Davis, Harbor City, CA (US); Rose Davis, Harbor City, CA (US)

( * ) Notice: Subject to any disclaimer, the term of this patent is extended or adjusted under 35 U.S.C. 154(b) by 0 days.

(21) Appl. No.: 12/940,212

(22) Filed: Nov. 5, 2010

Related U.S. Application Data

(60) Provisional application No. 61/346,142, filed on May 19, 2010.

(51) Int. Cl.
*A63H 33/00* (2006.01)
*A63H 3/14* (2006.01)

(52) U.S. Cl. ..... 446/26; 446/327

(58) Field of Classification Search ..... 446/26, 446/71–73, 268, 327–330, 369, 901
See application file for complete search history.

(56) References Cited

U.S. PATENT DOCUMENTS

| | | | | |
|---|---|---|---|---|
| 2,729,023 | A | 1/1956 | Lerner et al. | |
| 2,852,885 | A * | 9/1958 | Mayer | 446/327 |
| 2,902,693 | A * | 9/1959 | Wells, Jr. | 2/158 |
| 3,375,604 | A * | 4/1968 | Alonso | 446/92 |
| 3,835,582 | A * | 9/1974 | Stubbmann | 446/363 |
| 3,942,283 | A | 3/1976 | Rushton | |
| 4,054,006 | A * | 10/1977 | Estlund | 446/329 |
| 4,276,715 | A * | 7/1981 | Rogers | 446/329 |
| 4,304,065 | A | 12/1981 | Baiera | |
| 4,411,026 | A | 10/1983 | Secter | |
| 4,488,315 | A | 12/1984 | Hoerlein | |
| 4,543,669 | A * | 10/1985 | Katz | 2/84 |
| 4,585,425 | A * | 4/1986 | Amici et al. | 446/327 |
| 4,608,025 | A | 8/1986 | Amici et al. | |
| 4,610,640 | A | 9/1986 | Amici et al. | |
| 4,622,020 | A * | 11/1986 | Amici et al. | 446/298 |
| 4,681,555 | A | 7/1987 | Natiw | |
| 4,682,968 | A * | 7/1987 | Droller et al. | 446/268 |
| 4,799,889 | A | 1/1989 | Yockey | |
| 4,992,070 | A * | 2/1991 | Mullen et al. | 446/359 |
| 5,117,507 | A | 6/1992 | Long | |
| 5,362,271 | A * | 11/1994 | Butt | 446/139 |

(Continued)

FOREIGN PATENT DOCUMENTS

DE 4412858 10/1995

(Continued)

OTHER PUBLICATIONS

"Nics Puppets"; http:l/www.nicspuppets.com/home/Five Little Monkies_glove.html.*

(Continued)

*Primary Examiner* — Gene Kim
*Assistant Examiner* — Alyssa Hylinski
(74) *Attorney, Agent, or Firm* — Fish & Associates, PC

(57) ABSTRACT

A glove-doll entertainment system is presented. The glove-doll system allows for playing with the doll separate from the glove, playing with the doll attached to the glove, or using the glove as a hand covering without the doll. The appendages of the doll directly and removeably attach to exterior surfaces of the glove's finger receiving cavities. Each of the attached appendages can be separately articulated by finger movement. The doll is three dimensional and is physically distinct from the glove. Contemplated dolls can include an electronic circuit that generates a sound when an appendage is moved. A sequence of sounds can be generated by movement of a plurality of appendages to generate a song or a story. Contemplated gloves are sufficiently thick and waterproof to replace a regular pair of winter gloves.

18 Claims, 5 Drawing Sheets

U.S. PATENT DOCUMENTS

| | | | | |
|---|---|---|---|---|
| 5,385,573 | A | 1/1995 | Wright | |
| 5,472,364 | A | 12/1995 | Castleman | |
| 5,561,864 | A * | 10/1996 | DeMars | 2/209.13 |
| 6,126,507 | A | 10/2000 | Lieberman | |
| 6,279,167 | B1 * | 8/2001 | Johnson et al. | 2/209.13 |
| 6,866,643 | B2 | 3/2005 | Kramer | |
| 7,003,810 | B2 | 2/2006 | Goldkind | |
| 7,029,361 | B2 * | 4/2006 | Seibert et al. | 446/327 |
| 7,654,682 | B2 | 2/2010 | Denham | |
| 2003/0211808 | A1 | 11/2003 | Yarbrough | |
| 2004/0121702 | A1 | 6/2004 | Seibert et al. | |
| 2005/0074736 | A1 | 4/2005 | Perkins et al. | |
| 2006/0057918 | A1 * | 3/2006 | Burnett | 442/132 |
| 2009/0100571 | A1 | 4/2009 | Soto | |
| 2009/0193562 | A1 | 8/2009 | Magglo | |
| 2010/0154099 | A1 | 6/2010 | Lee | |

FOREIGN PATENT DOCUMENTS

| | | |
|---|---|---|
| GB | 1428859 | 3/1976 |
| WO | 96/21498 | 7/1996 |

OTHER PUBLICATIONS

Weinstein, T, "Kitten in Mitten Ornament 3", Toni's Collectibles, Pleasant Hill, CA, http://www.toniscollectibles.com/cgi-bin/store/TN Sstore.cgi?user_action=detail;catalogno=AN LE2116.*

The Gifted Goat, "Kidorable Ladybug Childrens Mittens", Wiltshire, UK, http://www.thegiftedgoat.co.uk/prodView.asp?idproduct=1001.*

Kites and More, "Marionette Clown, Ballerina and Girl", Hand & Finger Puppets, Lincolnshire, UK, http://www.kitesandmore.co.uk/contents/en-uk/d72_01.html.*

Kites and More, "Marionette Clown, Ballerina and Girl", Hand & Finger Puppets, Lincolnshire, UK, http://www.kitesandmore.co.uk/contents/en-uk/d7201.html.

<http://www.educationalinsights.com/product/teachers/category/imaginative+-+role+play/puppets/storytelling+glove.do?sortby=&>; Educational Insights; Nov. 2010; California, US.

* cited by examiner

GLOVE WITH ATTACHED DOLL

This application claims the benefit of priority to U.S. provisional application having Ser. No. 61/346,142 filed on May 19, 2010. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention relates to hand covering and toy assemblies.

BACKGROUND

When children go outside in cold weather, they typically wear gloves to keep their hands warm or dry. While wearing gloves, it is difficult to carry dolls or other toys, and sometimes toys are dropped, damaged, or even lost. As any parent knows when a child loses a favorite toy, the child become inconsolable. Having a doll or other type of toy configured to removeably and directly attach to an exterior surface of a glove can advantageously allow a child to play with the doll while also retaining full utility of the glove as a hand protecting device.

Some dolls include a hand-receiving cavity such that the toy can be used as a hand puppet. Others have developed various forms of hand-puppets combined with gloves. For example, U.S. Pat. No. 4,304,065 to Baiera describes a hand puppet associated with an in operative glove component. However, in Baiera the hand goes inside the body of the puppet, and all finger receiving cavities are disposed inside an appendage of the puppet while the glove is present to create an illusion of a glove. Thus, the glove lacks utility separate from the puppet. Another Example includes U.S. Pat. No. 4,610,640 to Amici, which describes puppet in combination with a glove. In Amici, the glove represents an integral part of the puppet where the fingers of the glove operate as appendages of the puppet. Again, the glove lacks utility as a separate hand protecting device because the glove is permanently affixed to the puppet.

Yet others have coupled toys with a glove while keeping the toy and glove distinct from each other. Great Britain patent 1,428,859 to Stubbmann describes a marionette coupled with a glove component where movement of the glove translates into movements of the marionette. In Stubbmann the toy couples with a glove by strings and also requires a stand for additional support. In this case the toy is configured to be at a distance from the glove to increase the illusion that marionette is autonomously controlled. Another example where a toy is distinct from a glove includes U.S. Pat. No. 7,003,810 to Goldkind, which describes a finger puppet in combination with a partial glove concealed in the knee pockets of a pair of jeans. In this case the partial glove lacks utility as a separate device and the small finger puppets can not be removed. In other references, as in the Educational Insights (See FIG. 1; see also URL www.educationalinsights.com/product/teachers/category/imaginative+-+role+play/puppets/storytelling+glove.do) and in U.S. patent application publication 2009/0193562 to Magglo, the disclosed systems require multiple distinct puppets or body parts where the puppets and body parts attach to a glove. In these cases, appendages of the puppets lack the ability to move independently from each other or the puppets are too small could be lost.

Independent movement of a doll's appendages would be desirable in a glove-doll combination. For example, U.S. Pat. No. 4,992,070 to Mullen describes an articulated toy figure having rings attached to certain movable limbs where the rings are intended to clamp onto a user's fingers. Finger movement then translates to movement of the toy's limb movement. Interestingly, in Mullen, the articulated toy is not attached to a glove component, but directly attaches to a finger.

A puppet capable of making sounds in response to user finger movement would also be desirable for increased play value. U.S. patent application publication 2004/0121702 to Siebert describes a finger toy that can generate a sound when tapped against a hard object. Ideally, a puppet would generate sounds in response to appendage movement, possibly generating a story.

A more ideal glove-doll combination would include a glove that can also be leveraged simply as a glove and include a physically distinct doll capable of removeably attaching to the glove via its appendages. In such a configuration, the glove retains its full utility as a glove and the doll can be played with separately without the glove. Furthermore, the doll can be attached to the glove for combined play as a puppet. A sufficiently large doll decreases the risk of loss. Even in view of the previous efforts directed toward combining dolls with gloves, no known effort has been focused on providing a doll having at least some of the appendages configured to removeably and directly attach to an exterior surface of the glove where movement of a finger within a finger receiving cavity of the glove causes independent and separate movement of the doll appendages.

Thus, there is still a need for a glove-doll combination that allows for play with the doll separate from the glove, play with the doll when attached to the glove, and use of the glove without the doll.

SUMMARY OF THE INVENTION

The inventive subject matter provides apparatus, systems and methods in which a doll is removeably coupled to a glove, wherein the doll is physically distinct from the glove and can also operate without the glove. The glove-doll combination forms an article of manufacture for use with a human hand. The body of the doll does not have to attach to the glove surface and at least some of the appendages are configured to removeably and directly attach to an exterior surface of the finger receiving cavities of the glove. Attaching the appendages to the exterior surface of the finger receiving cavities provides for independent movement of the appendages. The attached appendages can be separately articulated by finger movement while the glove retains full utility as a hand covering or protecting device.

The glove can be coupled to the doll using different types of couplers. Example couplings include stitching, magnets, straps, hook-and-loop fasteners, or other types of couplings that allow for a user to directly attach the doll appendages to the exterior surface of the glove and allow for easier detachment. In some embodiments, reusable adhesives can also be used. a coupling that allows a user to separate the glove from the doll.

All glove configurations are contemplated including gloves having a single finger receiving cavity, a mitten, or a five-fingered glove. When multiple finger receiving cavities are present, a first doll appendage can directly attach to an exterior surface of a first finger receiving cavity and a second, different one of the doll appendages can directly attach to an exterior surface of a second, different finger receiving cavity.

Separate attachment of the doll appendages provides for independent articulation of each appendage.

In some embodiments, the glove comprises thermal insulation, water resistant or waterproof materials. Such configurations enhance the utility of the glove as a hand protecting or covering device.

Preferred dolls are considered to be three dimensional having at least one body segment and one or more independent appendages coupled to the body. The body segment can lack any requirement to attach to the glove. The dolls can also include stuffing or plush covering.

The doll can further include an electronic circuit capable of generating a sound triggered by movement of at least one of the plurality of appendages. In some embodiments, a sequence of sounds can be triggered by movement of a plurality of appendages to generate a story.

In yet other embodiments the appendages can comprise a head that directly attaches to the exterior of the middle of the finger receiving cavities where the head is separately movable from other appendages. In such an embodiment, a sound can be generated when the head is nodded.

Various objects, features, aspects and advantages of the inventive subject matter will become more apparent from the following detailed description of preferred embodiments, along with the accompanying drawing figures in which like numerals represent like components.

DETAILED DESCRIPTION

The follow disclosure is directed toward a glove-doll combination. The disclosed techniques can also be applied to other configurations beyond those describe for use with a glove. It is contemplated that toys can be directly attached to shoes, clothing, or other body coverings. In addition, beyond dolls, a toy could include a robot, construction equipment, or other assemblies that can have separately articulating members. For example, a shirt could be configured to directly attach to appendages of a stuffed animal back pack where the arms of the stuff animal attached directly to the shirt's sleeves.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Figure 1:
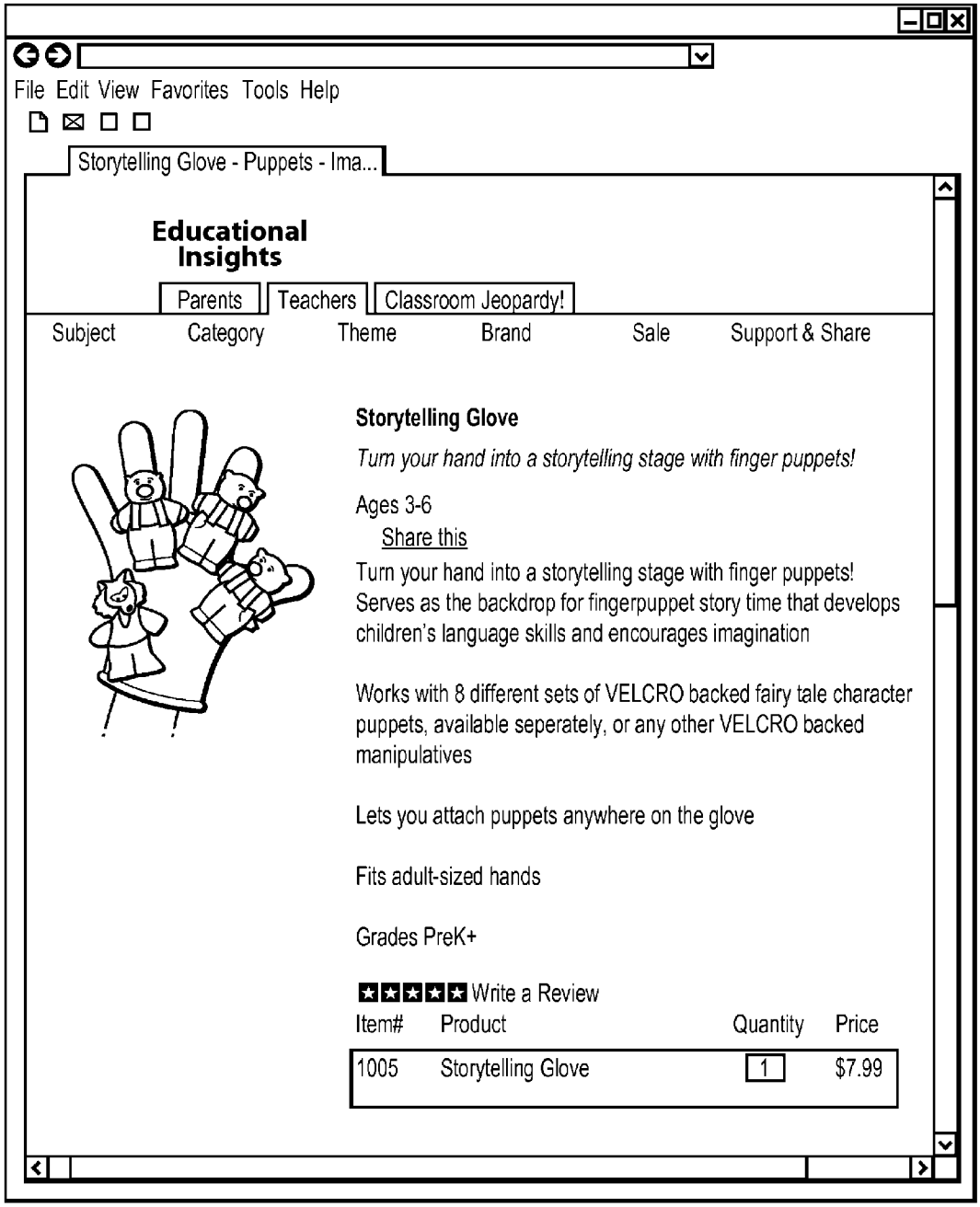
FIG. 1 PRIOR ART
FIG. 1 is a prior art example of an Education Insight story telling glove product.
Figure 2A:
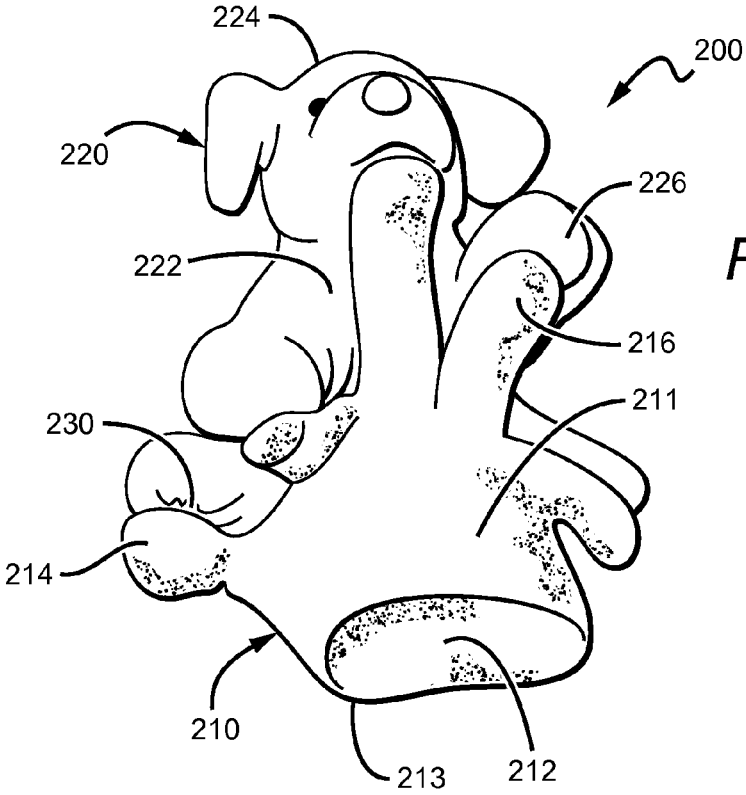
FIG. 2A presents a palm-facing view of glove-doll combination.
Figure 2B:
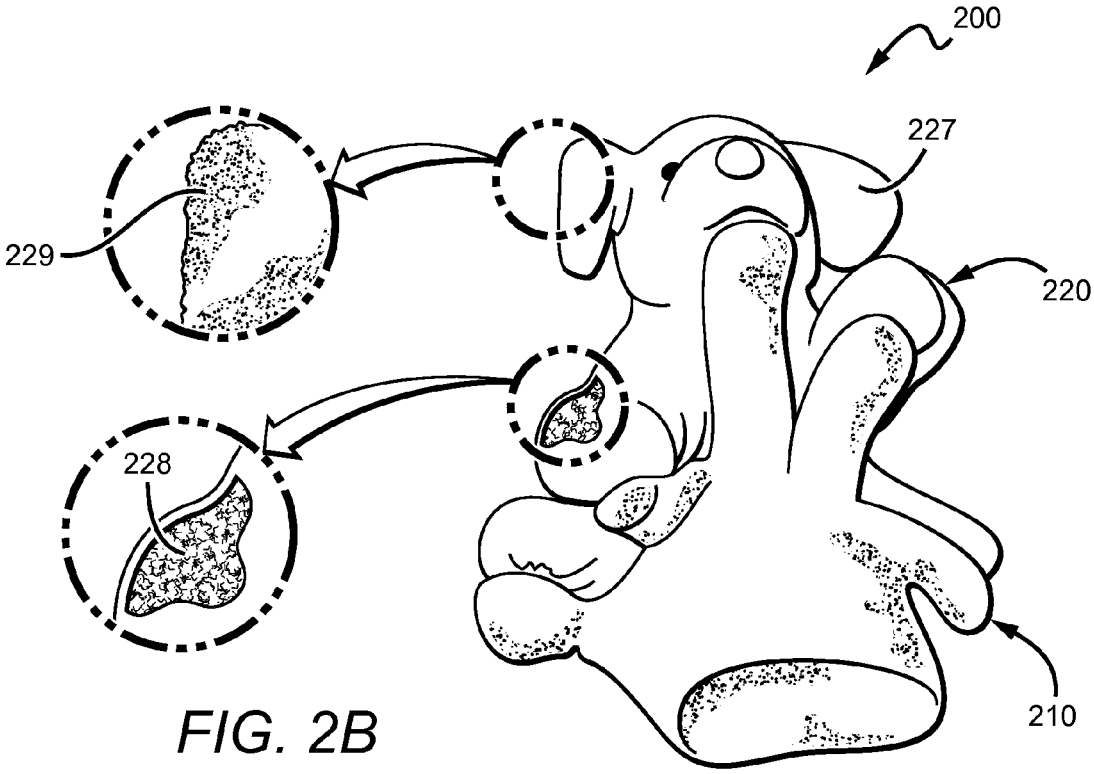
FIG. 2B presents a more detailed view of the glove-doll combination from FIG. 2A.

In FIGS. 2A and 2B, a glove-doll combination 200 generally comprises a glove 210 and a distinct doll 220. Glove 210 has an exterior palm surface 211, an exterior back surface 213, a hand-receiving cavity 212, one or more of a thumb-receiving cavity 214 and four other finger-receiving cavities 216. Glove 210 has hand-receiving cavity 212 from which extends one or more of finger receiving cavities 216. In the example shown, glove 210 comprises multiple finger receiving cavities 216, a first one of the appendages (e.g., head 224, feet 226, etc.) directly attaches to exterior surface of a first finger receiving cavity 216 and a second, different one of the appendages directly attaches to an exterior surface of a second, different finger receiving cavity 216.

Glove 210 can be constructed from any suitable materials with sufficient elasticity allowing a user to flex freely their hand, thumb, or fingers. In some embodiments, the glove is constructed of thermally insulating materials (e.g., wool, GORE-TEX®, etc.), or water resistant or waterproof materials (e.g., GORE-TEX®, leather, vinyl, etc.). The glove can be manufacture by knitting, stitching, weaving, or other process known to form gloves. One should also appreciate that the other materials can also be used to form gloves including natural materials or synthetic materials (e.g., SPANDEX®, LYRCA®, elastane, NEOPRENE®, etc.). More preferred gloves are constructed to offer hand protection against the elements and comprises thermal insulating materials and water resistant materials.

In FIGS. 2A and 2B, doll 220 represents a dog having body 222, a head 224, four feet 226 and a tail. Doll 220 preferably has body 222 and a plurality of appendages 226 or 224 where the appendages are independently moveable with respect to teach other. In addition doll 220 is physically distinct from and disposed externally to glove 210. Head 224, tail and feet 226 are all considered appendages stemming from body 222. One should appreciate that doll 220 could represent other types of objects having appendages including animals, robots, construction equipment, or other objects that a child would consider enjoyable as further described below. Here, doll 220 directly attaches to an exterior surface the finger receiving cavities on the back surface 213 of glove 210. One should note the appendages of doll 220 directly attaches to the exterior surface of glove 210 rather than attaching to the finger of the user. Such a configuration allows the user of glove 210 to move their fingers freely and the appendages of doll 220 to follow the movement of the user's fingers. Preferably at least some of appendages (e.g., head 224, feet 226, etc.) are configured to removeably and directly attach to an exterior surface of receiving cavities 214 or 216. Head 224 directly attaches to the exterior surface of the finger receiving cavity 216 (e.g., the middle finger of the glove) and feet 226 directly attach to the exterior surfaces of the remaining four finger receiving cavities 216 via hook and loop fastener 230. Advantageously, the doll body 222 lacks a direct attachment requirement to an exterior surface of the glove to allow appendages 224 and 226 to move freely relative to each other and body 222 while also allowing body 222 to flop or move somewhat independently from glove 210. Such an approach is advantageous because it is considered to enhance an illusion that doll 220 is distinct from the glove.

Suitable dolls are three dimensional, at least partially filled with an interior stuffing material 228 and have an outer cover 227 as seen in FIG. 2B. Here, doll 220 is covered with a plush material 229. At least some of the inside portions of the body 222, head 224, or feet 226 are configured to include stuffing material 228 to further enhance the three dimensional aspect of doll 220.

Outer cover 227 can be made of any suitable materials that are preferably water resistant or waterproof and can resist tearing. Contemplated materials include leather, cloth, or plush 229. In addition material can comprise all suitable textiles possibly including textiles made from polyester or nylon. Materials can be impregnated, coated or covered with coating materials including a polyurethane coating that can impart a water resistant property or a fluorescent pigment that can increase the visibility of the toy, especially in the dark. Contemplated materials can be of any color and more than one color can be used. In some embodiments at least a portion of the outer cover 227 includes a bright fabric that can fluoresce in the dark.

Contemplated stuffing materials 228 can include polyester fill, cotton, grain, beads or any other suitable materials. Stuffing materials can be selected to provide a soft, squishy tactile feel so that a child can easily articulate doll 220 when doll 220 is directly attached to glove 210 opcan hug and cuddle with doll 220 when doll 220 is removed from glove 210.

In other contemplated embodiments, a doll could represent some other animal, including another mammal, a bird or other non-mammal, an insect, a fanciful animal as for example a dragon with wings, or even a non-animal such as a house, a piano or a car. Thus, contemplated appendages could include feet, arms, wings, tails, wheels, doors, tentacles, piano keys or other body extensions that can flex freely from other body extensions.

Figure 3:
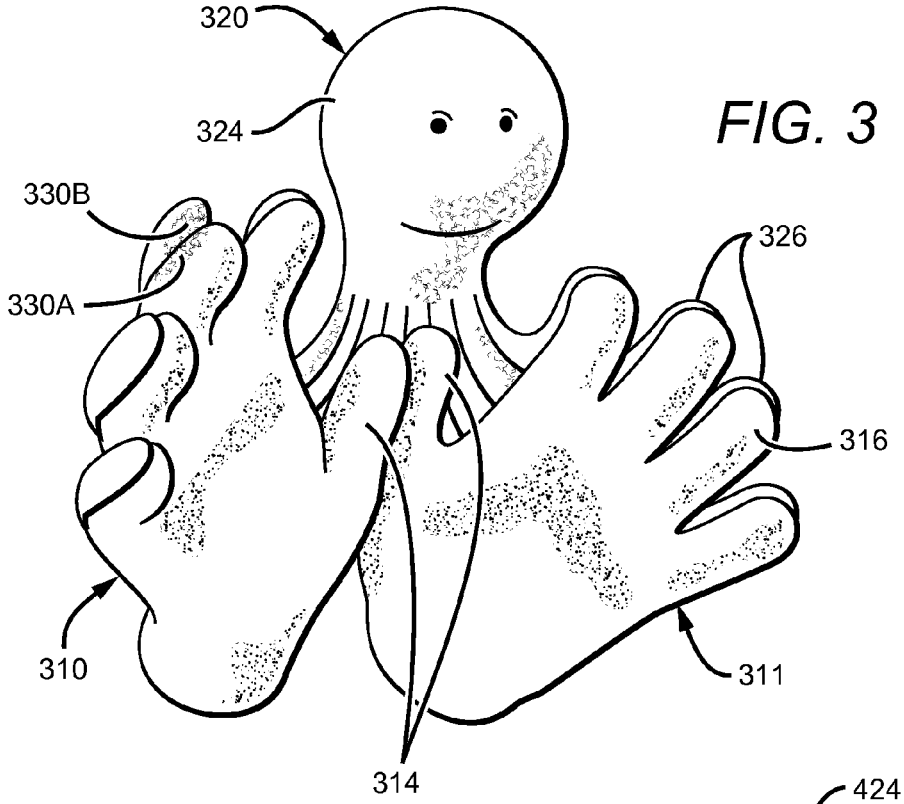
FIG. 3 represents two gloves with a single doll embodying the present invention.

To illustrate the above concept further, FIG. 3, presents doll 320 representing an octopus having eight tentacles 326, and a pouch-shaped head 324. One should note doll 320 is configured to be user-detachable from glove 310 or 311. Octopus 320 can couple with a pair gloves, a first glove 310 and a second glove 311. Such an arrangement illustrates that a single doll can be configured to couple with more than one glove. Thus, each of tentacles 326 can removeably attach to the exterior surface of an individual finger receiving cavity 316 and each of tentacles 326 can move freely relative to each other. Head 324 can directly and removeably attach an exterior surface of at least one of the thumb receiving cavity 314. In another configuration, (not shown) five of tentacles 326 are directly and removeably attached to first glove 310 each to an exterior surface of a different finger receiving cavity 316 and the thumb receiving 314. The remaining three tentacles 326 are directly and removeably attach to the second glove 311, each to an exterior surface of a different finger receiving cavity 316. In this configuration, the head directly and removeably attaches to the thumb receiving cavity 314 on the second glove 311.

The appendages 326 or 324 can removeably attach to the gloves preferably via a hook and loop fastener 330A and 330B, referred to collectively as fasteners 330, wherein one of the mating pair of hook and loop is 330A is placed on the exterior surface of a finger receiving cavity 316 or a thumb receiving cavity 314, and the mating fastener is 330B can be placed on the underside of tentacles 326 or the head 324. In some embodiments, a portion of gloves 310 or 311 can include an exterior surface comprising loops as part of the material composing gloves 310 or 311. For example, gloves 310 or 311 can comprise an exterior surface of terrycloth having loops (i.e., fastener 330B) that can mate with hooks of fastener 330A. One should note, fastener 330B is preferably at least positioned on the back side of receiving cavities 314 or 316. Fastener 330B can also run the length of the exterior surfaces of cavities 314 or 316 as desired.

One should note that contemplated gloves and dolls can be coupled with each other via fasteners 330 that allow a user to separate the glove from the doll as discussed with respect to FIGS. 2A and 2B and FIG. 3. All suitable attachment mechanisms that allow the doll to be user detachable from the glove are contemplated including magnets, straps, stitching, zipper, safety pins, snaps, or buttons or any combination thereof. It is contemplated that a stitching fastener can be utilized where the stitching includes loops on the doll and loops on the glove. The two sets of loops can be mated and joined via a safety pin or other items that can thread through both loops thus forming a user-detaching stitching fastener.

Figure 4A:
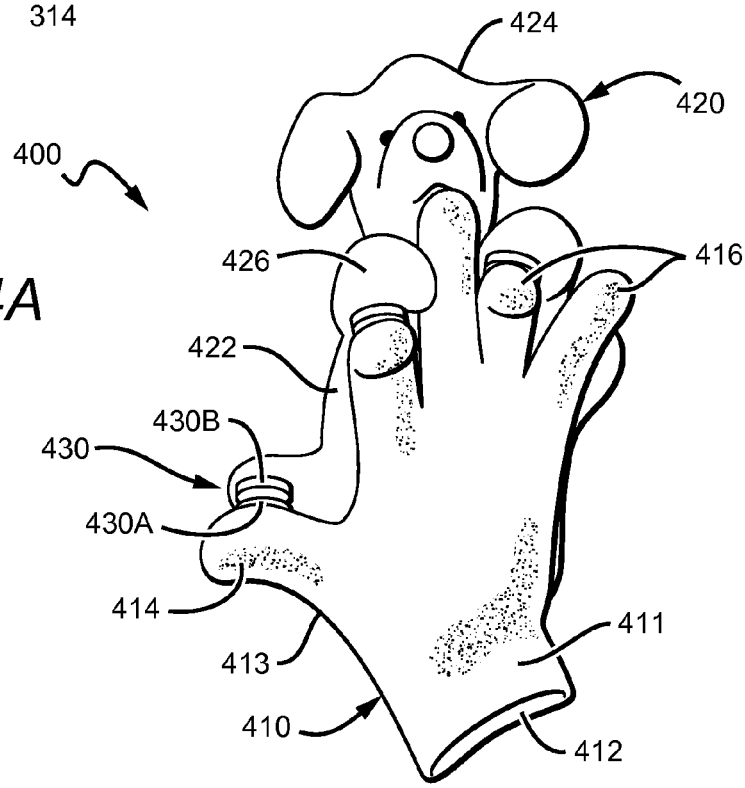
FIG. 4A represents palm-facing view of a glove-doll combination.

In FIG. 4A, glove-doll combination 400 comprises a glove 410 having a hand-receiving cavity 412, a thumb-receiving cavity 414, and four other finger-receiving cavities 416. As in the previous examples doll 420 represents a dog attached to back surface 413 rather than palm surface 411. In this example, the dog 420 couples to the exterior back surface 413 of glove 410. Head 424 and each of the four legs 426 directly and removeably attach to an exterior surface of the finger receiving cavities 414 and 416. The tail (not shown) does not directly attach to an exterior surface of the glove.

Here, the fasteners 430A and 430B, collectively referred to as fasteners 430, comprise magnets. Magnetic fasteners 430 include a mating pair of magnets where fastener 430A is on the exterior back surface 413 of the thumb receiving cavity 414 and each of the finger receiving cavities 416, and fastener 430B is on the underside of doll appendages 424 and 426. As previously discussed, the body of doll 420 lacks a direct attachment requirement to an exterior surface of glove 410 to allow appendages 424 and 426 to move freely relative to each other and body 422. More preferably, the body 422 and glove 410 simply lack an ability to attach to each other.

One should appreciate that movement of at least one finger can move at least one appendage 424 or 426 independently of other attached appendages, thus a head of the doll can be moved separately from all other appendages. In especially preferred embodiments, as shown here and in FIGS. 2 and 3, each of the directly attached appendages is independently movable with respect to each of the other directly attached appendages.

In preferred embodiments, the glove is a five-finger glove as shown in FIGS. 2A, 2B, 3, and 4A. In another contemplated embodiment, the glove is of mitten type, with a thumb receiving cavity and a finger receiving cavity for receiving the four fingers.

Figure 4B:
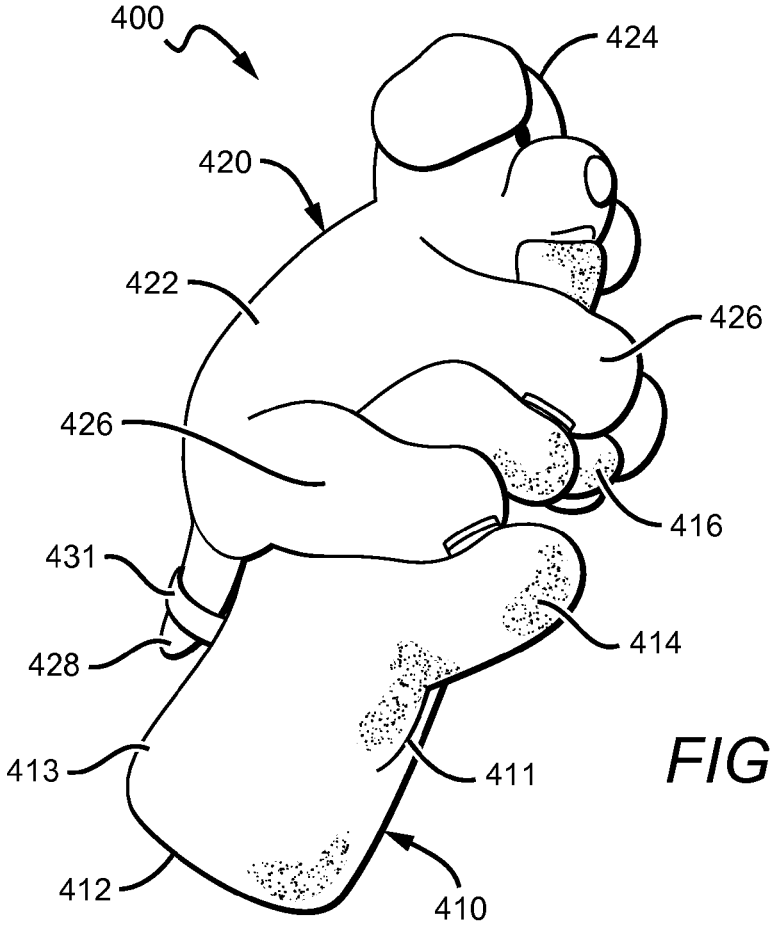
FIG. 4B represents a side view of the glove-doll combination from FIG. 4A.

FIGS. 4B for example, represents a side view of the glove-doll combination 400 where glove 410 could include a mitten type glove having a hand receiving cavity 412, a thumb receiving cavity 414, and a single large finger receiving cavity 416. Doll 420 can couples to glove 410 on the exterior back surface 413 of the glove, via all its appendages including tail 428.

Although less preferred, in this example tail 428 is directly and removeably attached to receiving cavity 414 or 416 via a strap 431 that allows independent movement with respect to the other appendages. The remaining appendages directly and removeably attach to the finger receiving cavities 416 also via a strap 431.

Dolls and gloves can be any suitable sizes and dimensions. Thus, for example, gloves can range from the smallest sizes for an infant, to a large version for an adult. Similarly, one could have a small glove with a large doll, a large glove with a small doll, or relatively similar sizes as shown in the figures. Preferably the dolls of are at least of a comparable size to the glove where a single doll can mate with one or more glove. One could also have matching dolls, for example two poodles of the same sizes, shapes and colors, or some degree of mismatch, as for example two poodles of different sizes or colors, or for example a dog and a cat, or a dog and a bird.

In more complex configurations, the glove doll combination can include at least an electronic circuit that can generate a sound when an appendage is articulated. The electronic circuit can be disposed inside the doll, inside the glove, distributed between doll and of the glove, or could be a separate device that can be coupled with the doll and glove. The separate device could be sold as an add-on enhancement to the glove-doll combination. Dolls comprising an electronic circuit can also be user detached from the glove and allow for play with the doll separate from the glove. In this configuration, the appendages of the doll are not directly attached to any of the user's fingers. Rather the appendages attach to an exterior surface of the glove, preferably an exterior surface of a finger receiving cavity. The electronic circuit inside the doll can generate a sound when an appendage or at least some of the appendages of the doll is moved by the user's hand, finger, elbow, head or other suitable portion of the user's body.

Figure 5:
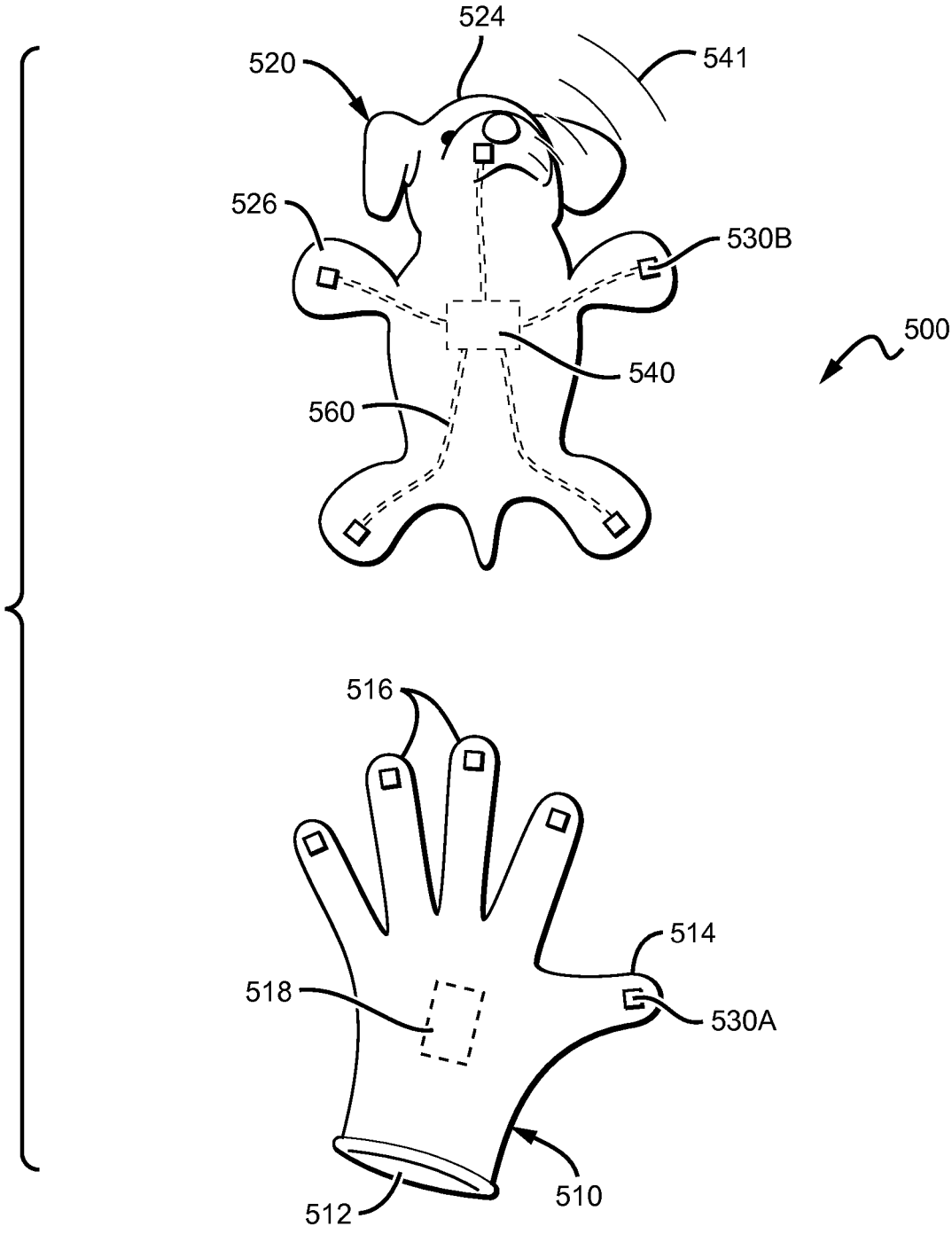
FIG. 5 represents a glove-doll combination an electronic circuit with sensors.

As an example of a sound generating embodiment, consider the glove-doll combination presented in FIG. 5. Glove-doll combination 500 comprises doll 520 that can include an electronic circuit 540, and can include sensors 560 disposed inside the appendages 524 or 526. Doll 520 can couples with glove 510 as previously described via fasteners 530A and 530B, collectively referred to as fasteners 530. Electronic circuit 540 can communicatively coupled with at least one sensor 560 disposed inside an appendage 524 or 526, which directly and removeably attaches to an exterior surface of finger receiving cavities 514 or 516. In this embodiment, electronic circuit 540 has five sensors 560 each disposed inside of separate appendages 526 and 524. Electronic circuit 540 is configured to produce sound 541 in response to sensing of movement of at least one of the head 524 or of the legs 526. For example, the head 524 can separately move from another appendage and can trigger a sound 541 when for example, nodded. When head 524 moves, electronic circuit 540 can cause a bark or other sound to be generated. Suitable electronic glove technologies that can be adapted for generating sounds in response to finger position within a glove include those described by U.S. Pat. No. 6,866,643 to Kramer titled "Determination of Finger Position", filed Dec. 5, 2000, and U.S. Pat. No. 7,654,682 to Denham titled "Glove Supporting a Pom Pom at a Finger Tip" filed Dec. 14, 2007.

In preferred embodiments each of the directly attached appendages 524 or 526 can trigger a sound 541. Sound 541 can be unique to a specific appendage, can be unique to a specific type of doll (e.g., dog, cat, robot, construction equipment, etc), or can be unique to a specific instance of a doll. Sound 541 can also comprise a different pitch, each associated with an emotion. For example movement of the head of a dog can trigger a medium pitch short bark that can be interpreted as friendly greeting, where movement of a second appendage can trigger a long bark sound at high pitch that can signify loneliness. When doll 520 represents a cat, the movement of the head can generate trigger a medium pitch short sound associated with a cat as for example a meow.

In other embodiments, movement of a plurality of appendages 524 or 526 in a particular sequence can trigger a plurality of sounds that can generate a sequence of sounds or tell a story. The sequence of sounds can represent for example a sequence comprising the seven syllables of a solfège to create a song. Such an approach provides for construction sounds based on "chords" of movements. In another example, the sequence of sounds can also represent a sequence of the letters of the alphabet. Yet in another example, sequences of sound and letters of the alphabet can be used in combination with each other to advantageously teach children the basics of the spoken language. When the sound comprises a word, a sequence of words can tell a story. As a child positions appendages of the doll in predefined arrangements, a next segment of the story can be generated.

Yet, in another embodiment, movement of a first appendage relative to movement of a second or third appendage can generate a doll configuration that can trigger a unique sound. For example a unique sound can be triggered when the doll representing a dog can be articulated to assume a first configuration having the finger receiving cavities in a closed position to simulate a resting or 'down' position of the dog. In this position, the four feet are each directly attached to an exterior surface of the finger receiving cavities. A different sound can be triggered when the dog assumes a second configuration as for examples having two feet moved in a raised position relative to the other two feet, to simulate a "sit" position. A unique sequence of sounds can be generated by articulating the dog from a first to second or third configurations.

In another example a sound can be triggered when an object is positioned between a first and a second appendage. Contemplated objects can represent a ball, a bone, a frisbee or any other objects that can be caught by a real life representation of the doll as for example a dog.

Figure 6:
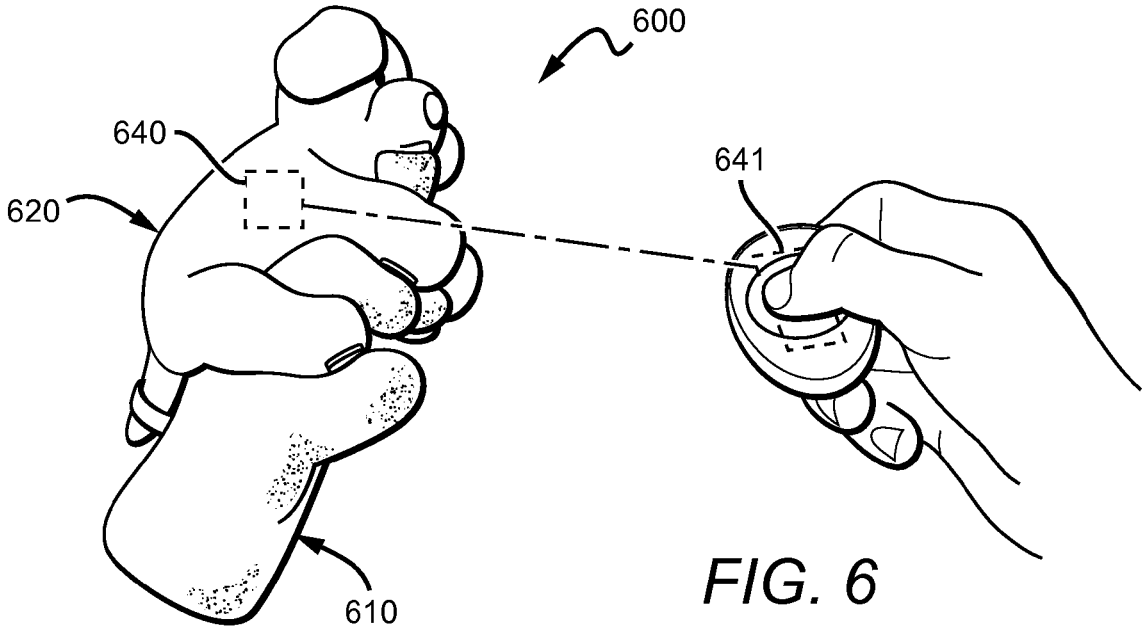
FIG. 6 represents a glove and doll combination keyed to a remote transmitter.

FIG. 6 presents another embodiment of a glove-doll combination 600. Advantageously, the electronic circuit 640 disposed inside the doll 620 can receive a signal from a remote transmitter 641 located inside a keyfob similar to a key finder. Electronic circuit 640 can generate a location finder signal to locate the user, as for example a loud sound or illumination of the doll when a signal is received from the remote transmitter 641. In other embodiments the doll is removed by the user and placed in a remote location. Here, the location finder signal can lead to finding the location of the doll, possibly as a hide and seek game.

Alternatively, a transmitter circuit 641 can be disposed inside glove 610 and can send a signal by the push of a button located on glove 610 to communicate with a receiver circuit disposed inside doll 620.

It is also contemplated that a doll can be specifically keyed to a glove. For example, the glove can include an RFID chip storing a glove identifier (e.g., GUID, UUID, serial number, etc.). When a doll is attached, the doll's electronic circuit can identify the glove and then provide appropriate sounds for the glove. In some embodiments, the doll can include a proximity sensor to allow a child to search for the doll. As the glove nears the doll, the doll can emit sounds in a manner to generate a "hot" or "cold" hide seek game. The inventive subject matter is considered to include placing on or more sensors or identifiers with the doll or glove. Providing such features allows the doll to be mated or paired with a glove or pair of gloves as desired.

One should appreciate that the electronic circuits discussed herein can be considered to comprise a processor configured to execute software instructions stored in a non-transitory, tangible memory. In a preferred embodiment, the electronic circuits are primarily disposed within the doll. The doll is considered to have a larger volume available for electronic circuits than the glove. However, it is also contemplated the components of the electronic circuit can be distributed across both the doll and glove as desired.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. An article of manufacture for use with a human hand, comprising:

a glove having a hand-receiving cavity from which extends at least one finger-receiving cavity; and a doll having a body and a plurality of independently moveable appendages, the doll physically distinct from and disposed externally to the glove; and wherein at least some of the appendages have a connecting mechanism to removeably and directly attach to an exterior surface of the glove and where the body lacks a connecting mechanism to directly attach to the exterior surface of the glove.

2. The article of claim 1, wherein the appendages attach to the exterior surface of the glove via a hook and loop fastener.

3. The article of claim 1, wherein the appendages attach to the exterior surface of the glove via a strap.

4. The article of claim 1, wherein the appendages attach to the exterior surface of the glove via a magnet.

5. The article of claim 1, wherein the appendages attach to the exterior surface of the glove via a stitching.

6. The article of claim 1, wherein the doll is user-detachable from the glove.

7. The article of claim 1, wherein the glove comprises a mitten.

8. The article of claim 1, further comprising multiple finger receiving cavities, and wherein a first one of the appendages directly attaches to an exterior surface of a first finger receiving cavity and a second, different one of the appendages directly attaches to an exterior surface of a second, different finger receiving cavity.

9. The article of claim 1, wherein the glove comprises a thermally insulating material.

10. The article of claim 1, wherein the glove is configured to be water resistant.

11. The article of claim 1, wherein the independent appendages comprise a head of the doll.

12. The article of claim 11, wherein the head, when attached, is configured to be separately movable from other attached appendages.

13. The article of claim 12, wherein the head attaches to the exterior surface of the finger receiving cavity.

14. The article of claim 1, further comprising an electronic circuit disposed within the doll that produces different sounds triggered by movement of different ones of plurality of appendages.

15. The article of claim 14, wherein the sound comprises a sequence of sounds based on a sequence of movements of at least two of the plurality of appendages.

16. The article of claim 15, wherein the sequence of sounds produced by sequential movement of different ones of the plurality of appendages, represents a story.

17. The article of claim 1, wherein the doll includes stuffing, and at least a portion of the doll has a plush covering.

18. The article of claim 10, wherein the body and glove lack ability to attach.

* * * * *